United States Patent [19]

Dorman

[11] Patent Number: 4,478,314

[45] Date of Patent: Oct. 23, 1984

[54] SAFETY SHIELD

[75] Inventor: Earl C. Dorman, Sulphur, La.

[73] Assignee: Olin Corporation, New Haven, Conn.

[21] Appl. No.: 412,472

[22] Filed: Aug. 30, 1982

[51] Int. Cl.[3] ..... B66B 9/20

[52] U.S. Cl. ..... 187/9 R; 296/78 R

[58] Field of Search ..... 187/1 R, 9 R, 9 E; 296/78 R, 78.1, 84 R, 84 D, 84 K, 84 E, 84 H; 280/1; 414/785

[56] References Cited

U.S. PATENT DOCUMENTS

| | | | |
|---|---|---|---|
| 2,441,132 | 5/1948 | Blakey | 293/54 |
| 2,564,002 | 8/1951 | Gibson | 414/785 |
| 2,635,916 | 4/1953 | Hammond | 296/78 |
| 2,826,450 | 3/1958 | Williams | 296/78 |
| 2,834,633 | 5/1958 | Ashton | 296/84 R |
| 2,911,232 | 11/1959 | Hastings, Jr. et al. | 280/150 |
| 3,023,919 | 3/1962 | Hobson | 414/785 |
| 3,336,074 | 8/1967 | Barnes et al. | 296/102 |
| 3,561,785 | 2/1971 | Kidder | 280/150 |
| 3,716,975 | 2/1973 | Smith | 296/78.1 |
| 3,866,242 | 2/1975 | Slagel | 2/2.5 |
| 3,891,265 | 6/1975 | Blackburn | 296/78.1 |
| 4,109,956 | 8/1978 | Roman | 296/78 |

*Primary Examiner*—Joseph J. Rolla
*Assistant Examiner*—Kenneth Noland
*Attorney, Agent, or Firm*—Ralph D'Alessandro; Donald F. Clements; Thomas P. O'Day

[57] ABSTRACT

In an industrial lift truck there is provided a safety shield that is detachably mountable to the lift assembly of the lift truck and is interpositioned between the operator's compartment and the material to be handled to protect the operator from any spillage, combustion or explosion of the materials during transport.

12 Claims, 5 Drawing Figures

SAFETY SHIELD

BACKGROUND OF THE INVENTION

This invention deals generally with industrial lift trucks. More particularly, it deals with a safety shield that is positioned on the lifting mechanism and movable therewith on the front of the lift truck between the operator's area and the materials that are being handled by the lift truck.

Industrial lift trucks, commonly known as forklifts, are employed in industrial applications routinely to lift and move industrial products from one location to another. Usually in the chemical industry, large quantities of chemicals are stored on pallets in drums or pail type of containers and must be moved from the storage area to a shipping area. Occassionally, the containers for the chemicals can rupture or the chemicals can become contaminated. When this occurs, there is the potential for a combustible or explosive reaction to occur under certain circumstances, or the chemicals can easily be spilled. Under these conditions, it is necessary to transport the contaminated or damaged containers to an open field or area where they can be isolated from the remainder of the chemical products.

Similarly, should a fire occur in an area where chemicals are stored, the danger from the spread of the fire to uninvolved pallets of chemicals is extreme. Under these conditions, it is advantageous to be able to move the uninvolved chemicals away from the fire area.

Attempting to use a forklift to move any chemicals under either of these conditions, however, exposes the operator of the forklift to danger. Should the chemicals explode or combust while they are being moved, the forklift operator could be seriously injured, since forklifts routinely have an open operator area without any protective screening or materials separating the operator from the material being handled.

Various protective devices have been designed for different vehicles to protect the operators from bodily harm. Tractors have had attachable cabs designed to be mounted to the vehicles in front of the operator's seat to protect the operator from wind and to deflect engine heat away from the operator. Tractors or bulldozers that are in danger of being struck by falling objects, such as trees or portions of buildings, have had protective covers mounted to the vehicles to deflect objects away from the operator's compartment and to protect the operator from injury. Similarly, forklifts have had overhead guards installed to protect their operators from falling objects. Motorcycles have had transparent bulletproof windshields designed to protect the drivers. However, no design has provided a readily detachable shield that moves with the material handling apparatus to be constantly interpositioned between the materials being handled and the operator.

This problem of the lack of safety protection for forklift operators between the operator's compartment and the material being handled is solved by the design of the apparatus comprised in the present invention.

SUMMARY OF THE INVENTION

It is an object of the present invention to provide an impenetratable safety shield for an industrial lift truck that will protect the operator during the handling of materials from the hazards of fire and explosive chemicals.

It is a feature of the present invention that couplings are employed to connect the safety shield to the lift assembly of the industrial lift truck to permit the safety shield to be easily and quickly detached.

It is another feature of the present invention that the safety shield is movable with the lift assembly so that it constantly stays between the operator and the material being handled.

It is another feature of the present invention that the forks of the lift assembly pass through the bottom of the safety shield and are used to securely anchor the safety shield to the lift assembly.

It is an advantage of the present invention that the safety shield is both simple in design and effective.

It is another advantage of the present invention that the safety shield is readily detachable from an industrial lift truck.

It is a further advantage of the present invention that the safety shield employs a pane that is transparent and resistant to explosions.

These and other objects, features and advantages are obtained by providing a safety shield for use in an industrial lift truck having a transparent pane that is detachably mountable to the lift assembly of the lift truck and is interpositioned between the operator's compartment and the materials to be handled to protect the operator from any spillage, combustion or explosion of the materials during transport.

BRIEF DESCRIPTION OF THE DRAWINGS

The objects, features and advantages of this invention will become apparent upon consideration of the following detailed disclosure of the invention, especially when it is taken in conjunction with the accompanying drawings wherein.

DETAILED DESCRIPTION OF THE PREFERRED EMBODIMENT

Figure 1:
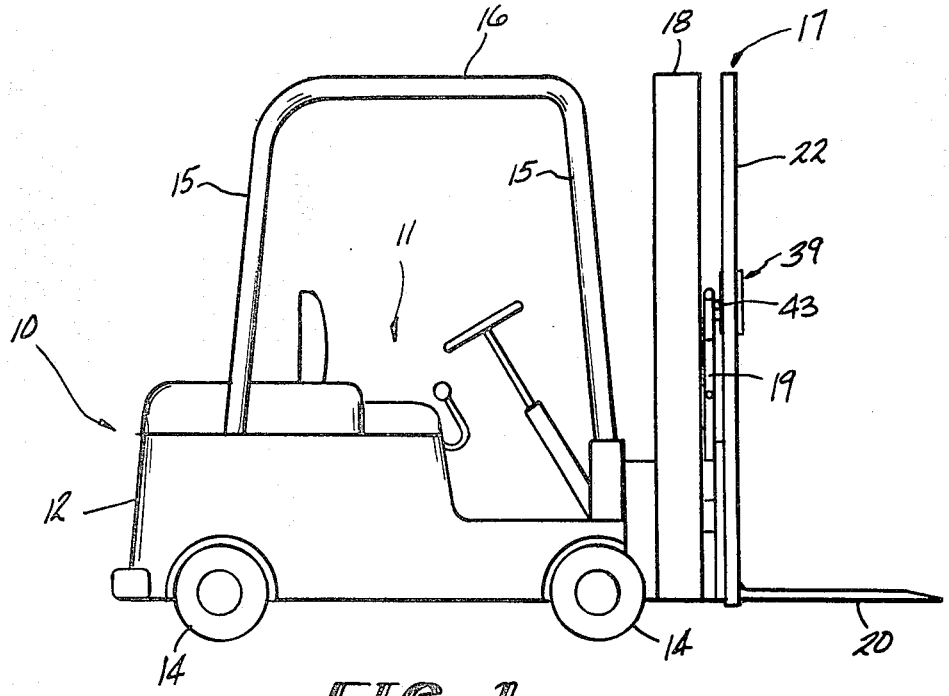
FIG. 1 is a side elevational view of a forklift truck having a safety shield mounted to the lift assembly.

FIG. 1 shows a lift truck or forklift, indicated generally by the numeral 10. The operator's area or compartment is indicated generally by the numeral 11. A body 12 is mounted on wheels 14, only two of which are shown. Generally, either the front or the rear wheels are steerable to permit the forklift to be maneuvered. An engine (not shown) is provided within the body 12, generally behind and beneath the operator's area 11, to provide the power to move the vehicle. Roof posts 15 are provided on the front and rear sides (only one of each being shown) to support a roof 16 and to give some side and top protection for the operator.

A lift mechanism is shown, generally indicated by the numeral 17. The lift mechanism 17 is composed of a lift support track 18 that typically employs a telescopic mast structure or lift frame 19 that is operatively connected to either one or a plurality of hydraulic cylinders with piston rods (all not shown) to move it upwardly and downwardly. The lift frame 19 typically includes an outer guideway formed by a pair of channel members and an inner channel construction which telescopes within the outer guideway (all not shown). Attached to the bottom of the lift frame 19 is a plurality of lift forks 20, only one of which is shown. The lift truck or forklift 10 has been described only generally, since the structure is well known in the art.

Figure 2:
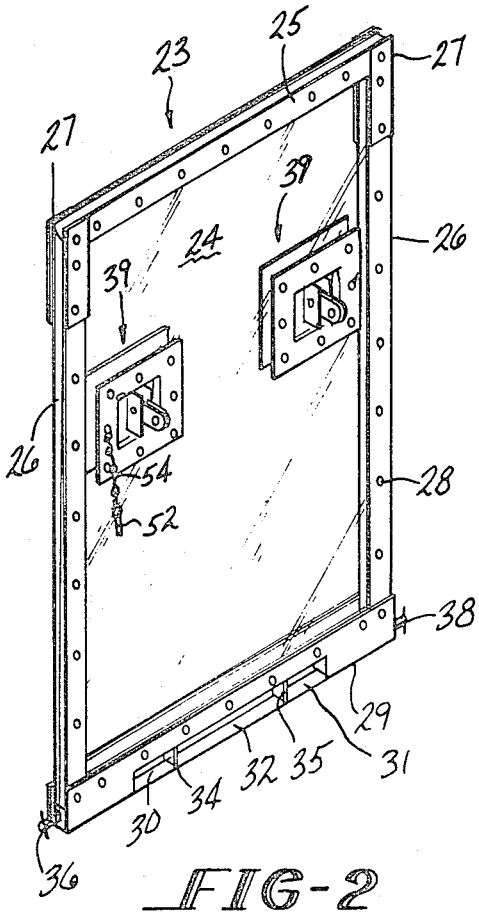
FIG. 2 is a top perspective view of the safety shield detached from the forklift truck.

A protective shield 22 is shown mounted to the lift mechanism 17 in FIG. 1. FIG. 2 shows the shield 22 in greater detail. The shield is composed of a shield frame, indicated generally by the numeral 23, that is formed from a top frame member 25, two side frame members 26 and a bottom frame member 29. The frame 23 is reinforced at its top corners by reinforcement corner plates 27. The shield frame is fastened about a generally rectangularly sized transparent pane 24 of explosion resistant material. The individual frame members are secured to the transparent pane 24 by a plurality of frame bolts 28 about the periphery of the shield 22. The transparent pane 24, as mentioned, is formed from an explosive resistant material that is also resistant to fire and heat. A number of plastic laminates may be used to form this shield 22. For example, a preferred composition may employ composites of polycarbonate sheets that are laminated together with a transparent adhesive system containing ultraviolet stabilizer additives to prevent yellowing or discoloration with aging. Such a material has been sold by the Sheet Products Section of the General Electric Company under the trademark LEXGUARD ® bullet resistant laminate.

Figure 3:
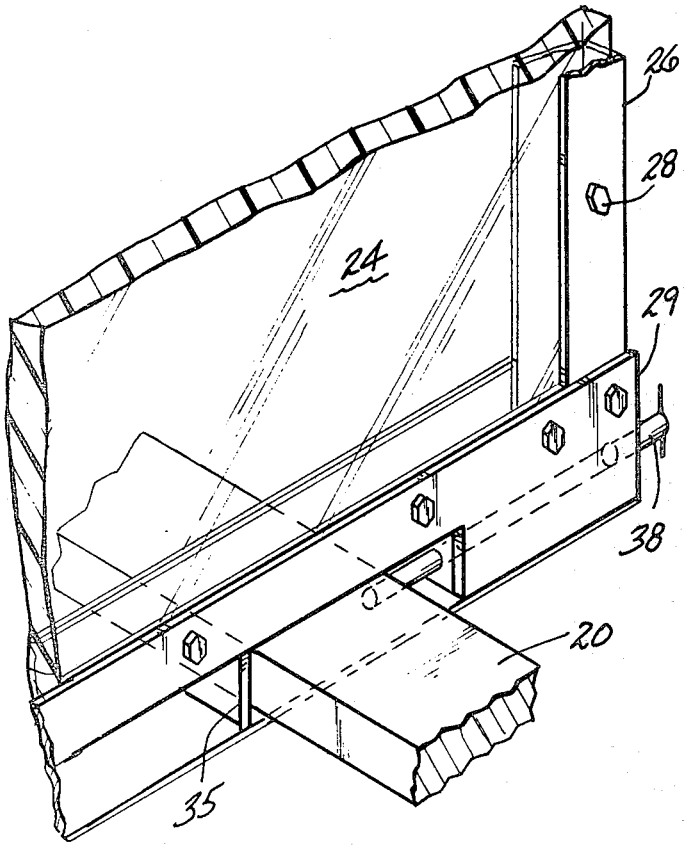
FIG. 3 is a partial enlarged view of the bottom frame member and a portion of the transparent pane showing how one fork passes through the opening in the bottom member of the frame and how the safety shield is secured thereagainst.

The bottom frame member 29 is seen to have openings therethrough. A left fork opening 30 and right fork opening 31 are provided to permit the lift forks to pass through the shield during the mounting operation. Each fork opening is terminated by a retaining plate; a left retaining plate 34 and a right retaining plate 35 being shown in FIG. 2. FIG. 3 shows in enlarged fashion the passage of a lift fork 20 through the right fork opening 31. The lift fork 20 is positioned against the right retaining plate 35 by the pressure of the right tightening bolt 38 that fits through an appropriately sized aperture in the bottom frame member 29. Tightening bolt 38 may then be tightened so that it presses against the lift fork 20 so that the lift fork is retained on the one side by the retaining plate 35 and on the other by the tightening bolt 38. A similar arrangement is used for the left retaining plate 34, the left tightening bolt 36 and the corresponding lift fork 20.

Figure 4:
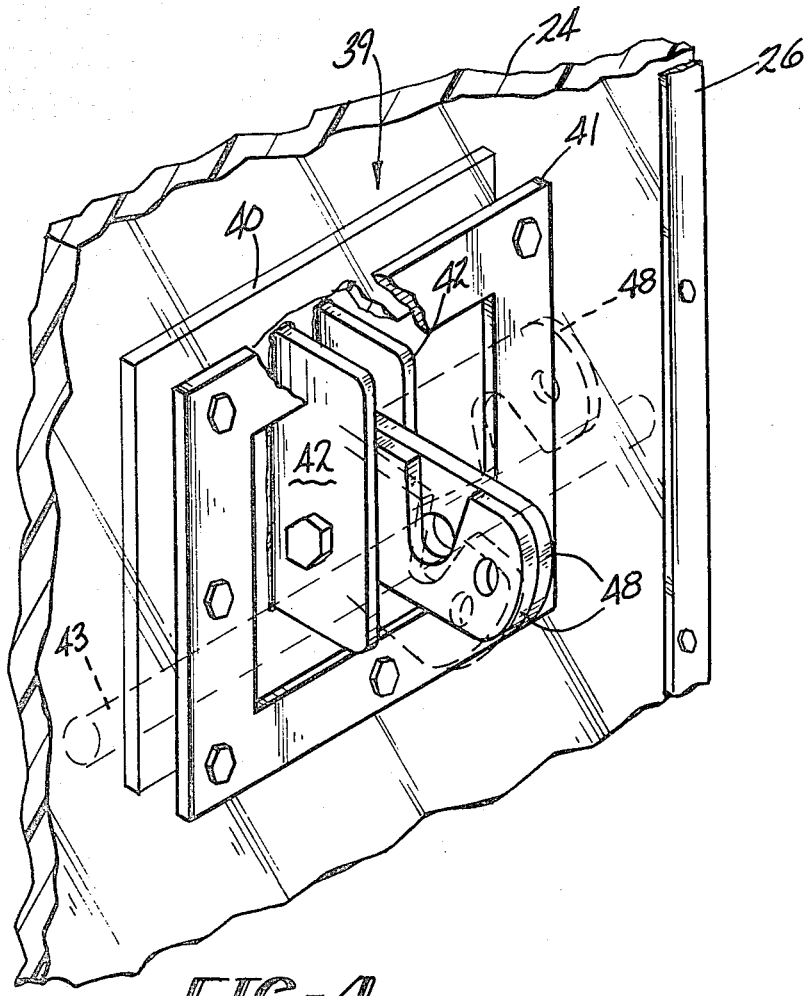
FIG. 4 is a partial enlarged perspective view of the upper shield coupling means that are employed to fasten the safety shield to the upper portion of the lift assembly.

FIG. 2 also shows the upper shield fastening assemblies or coupling means, indicated generally by the numerals 39. Coupling means 39 is best shown in enlarged fashion in FIG. 4 wherein it is seen that an outer shield fastening plate 40 and an inner shield fastening plate 41 are positioned on opposing sides of the transparent pane 24. A pair of retaining brackets 42, that are generally parallel and spaced apart, are fixedly fastened, such as by welding, to the outer shield fastening plate 40. An appropriately sized opening (not shown) in the transparent pane 24 is provided to pass the spaced apart retaining brackets 42 through. The inner fastening plate 41 is hollowed out so that it fits about the retaining brackets 42. Also seen in FIG. 4 are the pair of notched brackets 48 within which the lift frame bar 43 from the lift frame 19 is secured in a manner that will be explained hereinafter.

Figure 5:
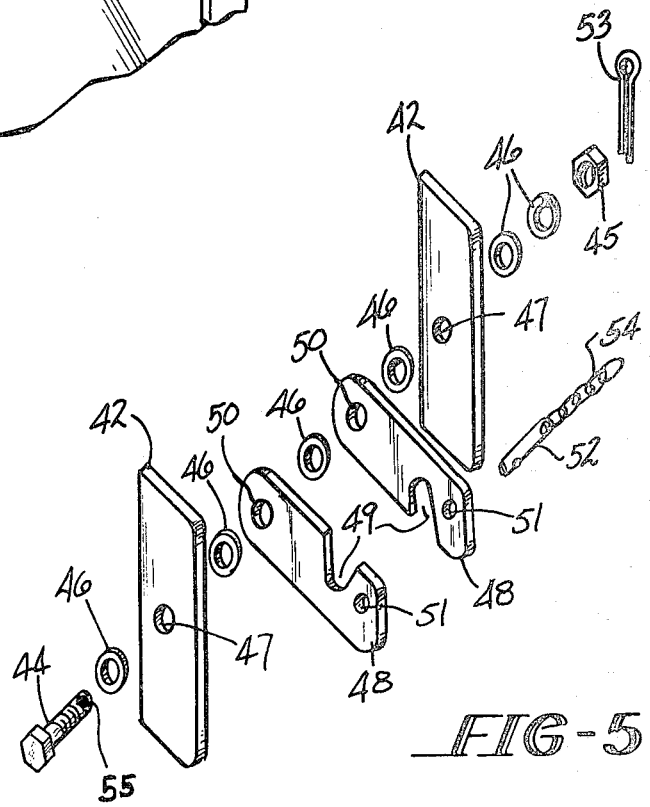
FIG. 5 is an exploded view showing the brackets and other fastening means that are employed in the upper coupling means to secure the safety shield to the lift assembly.

FIG. 5 shows in exploded view fashion the assembly of the notched brackets 48 to the retaining brackets 42. A bolt 44 is passed through a washer 46 and the aperture 47 in retaining bracket 42. Next, another washer 46 is placed over the bolt 44 and the bolt 44 is passed through the hole 50 in the first of the notched brackets 48. Another washer 46 is placed over the bolt 44 and the second notched bracket 48 is placed over the bolt. An additional washer 46 is placed between the second notched bracket 48 and the second retaining bracket 42 prior to the bolt being passed through the aperture 47 in the second retaining bracket 42. A pair of washers 46 is then placed about the bolt 44 and a nut 45 is threaded onto the bolt 44. A cotterpin 53 is provided to be placed in an opening 55 at the tip of the bolt 44. It will be noted that one notched bracket 48 is placed with the groove 49 opening upwardly while the other notched bracket 48 is placed with the groove 49 opening downwardly. Once placed together, as best seen in FIG. 4, this provides an effective retaining mechanism about the lift frame bar 43. To insure that the notched brackets 48 do not rotate apart, a retaining clip 52, seen in FIG. 5, is passed through the apertures 51 in the notched brackets 48. A chain 54 is fastened to the retaining clip 52 and is fastened to the inner shield fastening plate 41, as best seen in FIG. 2, to prevent the clip 52 from being lost.

The protective shield 22 is mounted to the lift truck 10 by sliding the shield 22 over the lift fork 20 and through the left fork opening 30 and right fork opening 31 in the bottom of the frame member 29. Once the protective shield 22 has been moved rearwardly so it is against the lift frame 19, the left tightening bolt 36 and the right tightening bolt 38 are tightened so the lift forks 20 are held firmly against the retaining plates 34 and 35. The notched brackets 48 of coupling means 39 then are positioned about the top and bottom of the lift frame bar 43 and securely fastened together by the retaining clip 52. The nut 45 is tightened about the bolt 44 until coupling means 39 are securely fastened to the lift frame bar 43 and then the cotterpin 53 is inserted through the opening 55 at the tip of bolt 44. The other coupling means 39 is similarly secured to the lift frame bar 43 so that the safety shield 22 is then mounted to the lift truck 10 and is ready for use.

While the preferred structure in which the principles of the present invention have been incorporated is shown and described above, it is to be understood that the invention is not to be limited to the particular details thus presented, but, in fact, widely different means may be employed in the practice of the broader aspects of this invention. The scope of the appended claims is intended to encompass all obvious changes in the details, common materials and arrangements of parts which will occur to one of ordinary skill in the art upon a reading of this disclosure.

Having thus described the invention, what is claimed is:

1. A material handling vehicle to protect the operator from the potentially explosive or flammable materials being handled, comprising:

(a) a mobile frame having a plurality of wheels at least some of which are steerable;

(b) an operator compartment mounted on the mobile frame from which the operator controls the vehicle;

(c) lifting means at least partially movably mounted to the frame, at least a portion of the lifting means engaging the materials being handled;

(d) at least partially transparent shield means having opposing first and second surfaces for protecting the operator, the shield means being detachably mounted to and movable with the lifting means interpositioned between the operator compartment and the portion of the lifting means engaging the materials being handled;

(e) coupling means connected to the shield means for coupling the shield means to the lifting means and having at least a first fastening plate fastened to the opposing first surface and at least a second fastening plate fastened to the opposing second surface; and said coupling means further having (f) a plurality of generally parallel, spaced apart retaining brackets fixedly fastened to the at least first fastening plate and extending to the at least second fastening plate to provide support for means to attach the shield means to the lifting means.

2. The apparatus according to claim 1 wherein the lifting means is further movable in a generally vertical direction.

3. The apparatus according to claim 2 wherein the lifting means further comprises a lift support track fastened to the mobile frame operably connected with a vertically movable lift frame.

4. The apparatus according to claim 3 wherein the portion of the lifting means engaging the materials being handled comprises the vertically movable lift frame.

5. The apparatus according to claim 4 wherein the vertically movable lift frame further comprises lift forks.

6. The apparatus according to claim 5 wherein the shield means further comprises a frame of predetermined height and predetermined width into which a transparent pane with opposing first and second surfaces is mounted.

7. The apparatus according to claim 1 wherein the transparent pane has at least one opening adjacent the coupling means.

8. The apparatus according to claim 7 wherein the means supported by the at least second fastening means to attach the shield means to the lifting means comprises at least a first notched bracket and at least a second generally parallel notched bracket, each bracket having a periphery with a predetermined length and a notch intermediately positioned at a predetermined distance along that length, the at least first notched bracket and the at least second notched bracket being adapted to cooperatively engage and retain a portion of the lift frame.

9. The apparatus according to claim 8 wherein the frame into which the transparent pane is mounted further includes at least a top member and a generally parallel bottom member, the bottom member further having a plurality of openings therethrough to receive the lift forks.

10. The apparatus according to claim 9 wherein the frame further includes a plurality of generally vertical retaining plates within the plurality of openings in the bottom member engageable with the lift forks.

11. The apparatus according to claim 10 wherein the frame further includes a plurality of retaining bolts that threadingly are insertable through the bottom member to engage the lift forks and force the shield to move laterally so that the generally vertical retaining plates engage the lift forks.

12. The apparatus according to claim 11 wherein the transparent pane is formed from laminates of polycarbonate sheets.

* * * * *